US006943655B1

(12) United States Patent
McMahon et al.

(10) Patent No.: US 6,943,655 B1
(45) Date of Patent: Sep. 13, 2005

(54) DIRECT CURRENT CONTACTOR ASSEMBLY

(75) Inventors: Todd McMahon, Greenfield, WI (US); Dennis A. Maller, Racine, WI (US)

(73) Assignee: Trombetta, LLC, Menomonee Falls, WI (US)

( * ) Notice: Subject to any disclaimer, the term of this patent is extended or adjusted under 35 U.S.C. 154(b) by 68 days.

(21) Appl. No.: 10/788,883

(22) Filed: Feb. 27, 2004

(51) Int. Cl.[7] ..... H01H 13/04; H01H 9/02

(52) U.S. Cl. ..... 335/202; 335/131; 335/278; 335/282; 335/299

(58) Field of Search ..... 335/78–86, 127–135, 335/202, 255, 278, 282

(56) References Cited

U.S. PATENT DOCUMENTS

| | | | |
|---|---|---|---|
| 1,005,899 | A | 10/1911 | Stout |
| 1,691,920 | A | 11/1928 | Chapman |
| 1,918,798 | A | 7/1933 | Churcher |
| 1,955,201 | A | 4/1934 | Nette |
| 2,373,587 | A | 4/1945 | Martin-Hurst |
| 2,591,336 | A | 4/1952 | Bordelon |
| 2,732,456 | A | 1/1956 | Van Ryan |
| 2,749,403 | A | 6/1956 | Horman et al. |
| 3,062,992 | A | 11/1962 | Dahl et al. |
| 3,094,596 | A | 6/1963 | Watson |
| 3,109,904 | A | 11/1963 | Koertge et al. |
| 3,148,255 | A | 9/1964 | Myrent et al. |
| 3,217,124 | A | 11/1965 | Terry |
| 3,230,490 | A | 1/1966 | Johnson |
| 3,274,525 | A | 9/1966 | Valleau |
| 3,284,742 | A | 11/1966 | Pettit et al. |
| 3,643,526 | A | 2/1972 | Thornburgh |
| 3,739,311 | A | 6/1973 | Garbark |
| 3,757,611 | A | 9/1973 | Buck |
| 3,783,344 | A | 1/1974 | Ono et al. |
| 3,815,060 | A | 6/1974 | Turnbull |
| 4,041,430 | A | 8/1977 | Hrynewycz |
| 4,112,576 | A | 9/1978 | Gross |
| 4,131,866 | A | 12/1978 | Torr |
| 4,134,698 | A | 1/1979 | Schantz |
| 4,186,363 | A | 1/1980 | Schmidt, Jr. et al. |
| 4,203,084 | A | 5/1980 | Yamaguchi et al. |
| 4,213,108 | A | 7/1980 | Gross |
| 4,262,271 | A | 4/1981 | Bowers et al. |
| 4,293,835 | A | 10/1981 | Davis et al. |
| 4,382,241 | A | 5/1983 | Hehl |
| 4,398,165 | A | 8/1983 | Iketani |
| 4,404,533 | A | 9/1983 | Kurihara et al. |
| 4,439,751 | A | 3/1984 | Gibas |
| 5,521,566 | A | 5/1996 | Krubsack et al. |

*Primary Examiner*—Ramon M. Barrera
(74) *Attorney, Agent, or Firm*—Ryan Kromholz & Manion, S.C.

(57) ABSTRACT

A direct current contactor having at least one low current terminal and at least two high current terminals is disclosed. The low current terminal is connected to a spring, which is nested in a chimney-shaped receptacle, where it is coupled to the contactor's coil. The chimney shaped receptacle also has a slot that receives a terminal blade that electrically connects the spring to the coil. The housing of the solenoid is designed with longitudinally extending channels that receive the receptacles, which prevents the assembly from rotating within the housing unit. Each terminal is provided with ribbed and knurled areas to restrict rotation of the terminal in the housing and the mating connection while tightening.

24 Claims, 5 Drawing Sheets

DIRECT CURRENT CONTACTOR ASSEMBLY

BACKGROUND OF THE INVENTION

The present invention relates to contactors and more specifically to a direct current contactor for selectively closing the connection between a fixed pair of high current terminals by supplying a low current to the contactor.

Direct current contactors include a high current switch and a solenoid in a single enclosure. The switch provides the desired function, to turn current flow on and off. The solenoid serves as the actuator for the switch, thereby allowing the switch to be controlled remotely via a low current control device.

Most commonly, the switch portion is a normally open switch of the single pole single throw variety. In operation, the switch contacts are open with no power applied to the solenoid and are actuated to the closed condition when power is applied to the solenoid.

Direct current contactors are commonly used to supply power between a battery and starter for various over-the-road and off-road vehicles such as automobiles, trucks, tractors, construction machinery and the like. The contactor and solenoid are connected in a circuit between the battery, electric starter and starter switch. The contactor is connected in series with the battery and starter in a high current environment.

During the manufacturing process of a contactor, numerous components must be assembled in sequence. It is a further requirement that the components be retained from dislodgement and/or rotation during assembly and use. It is also desirable that the assembly gives the installer a tactile confirmation that the installation was completed without damage to the unit.

SUMMARY OF THE INVENTION

The present invention provides a reliable contactor that may be reconfigured to be grounded to a mounting bracket or a separate terminal. The contactor comprises a housing unit having at least two high current terminals and at least one low current coil terminal located and sealed within the surface of the housing unit, with one end of the terminal protruding into the housing unit, and one end of the terminal extending outward from the surface. The terminals are designed with a ribbed or knurled center area that prevents the terminals from rotating within the housing surface. Also included are several steps along the terminals axes to assist in seal integrity. The terminals further have a knurled surface on the outward connecting end of the terminal. The knurled surface assists in connecting to an external wire, cable, or other device, since the knurled surface also restricts terminal rotation.

The solenoid also comprises a bobbin with a conductive coil wrapped around the bobbin. The bobbin has a plurality of projections located on the outer edges of the bobbin's ends. The projections each have a chimney structure or retaining receptacle that permits holding of a spring within the chimney. The projections also have a slot that may receive a conductive terminal blade or coupling means. The spring retained in the chimney is in connection with the low current terminal or terminals, and possibly a contactor cover for a solenoid that is grounded to its mounting surface. The terminal blade connects the coil to the spring and allows a current to flow through the solenoid coil. The design of the chimneys allows for easy assembly of the solenoid with the contactor housing.

The housing unit of the contactor is designed to receive the bobbin in a mating arrangement that will prevent the bobbin from rotating within the housing once assembled. The housing design, which has preformed, longitudinally extending channels to receive the projections on the bobbin, also makes it easier to properly align the bobbin when inserting the solenoid assembly into the housing unit.

The overall design of the contactor allows for a more efficient assembly than prior contactor arrangements. These and other features will become evident in the following description and drawings.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
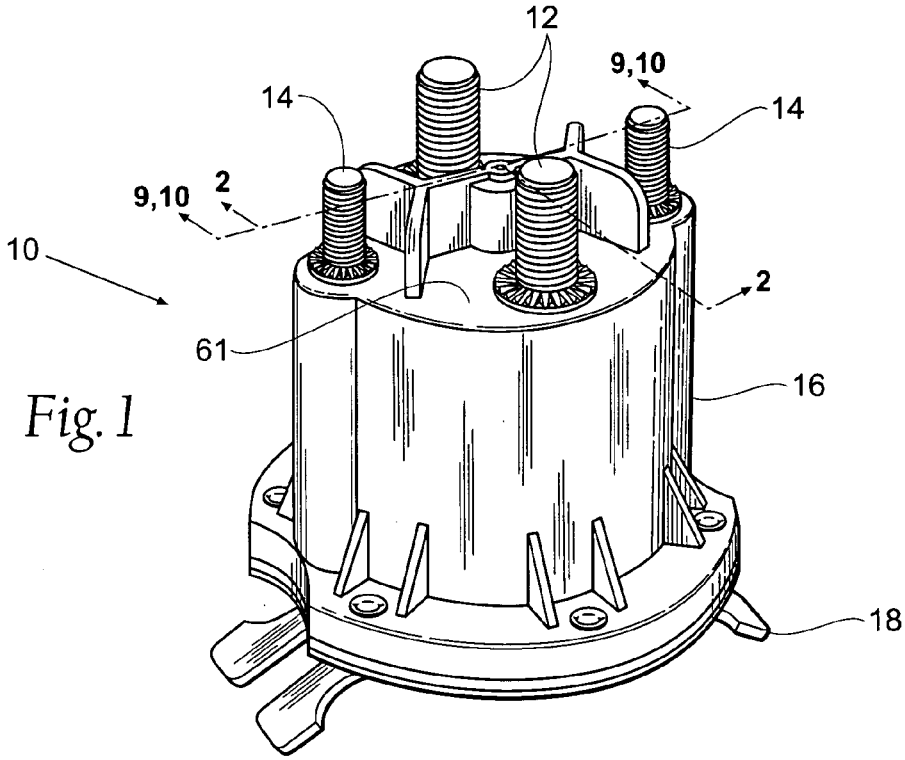
FIG. 1 is a perspective view of a contactor according to the present invention.

A direct current contactor 10 according to the present invention can be seen generally in FIG. 1. The contactor 10 is shown having a pair of high current studs or power terminals 12 and a pair of low current studs or terminals 14. In the embodiment shown, the contactor is a normally open contactor of the single pole single throw variety. The contactor 10 may operate with more or fewer studs 12 and 14 as in, for example only, a single pole double throw contactor. This variety of contactor typically has three or four high current studs 12 whereby one set is normally open and the other is normally closed.

The high current stud 12 and the lower current stud 14 will be referred to in the description as single items for the sake of clarity and not as a limitation on the invention. The studs 12 and 14 each sit within a housing unit 16, which is attached to an end plate, cover, or mounting bracket 18.

While the mounting bracket 18 is shown to be a unitary piece, it is conceivable that a cover without mounting structure may replace the mounting bracket 18. In such an instance, separate attaching or clamping means would be used to secure the contactor 10 in place. Provided that the end plate or cover 18 secures the required elements within the housing unit 16, any suitable structure may act as the mounting bracket 18.

Figure 2:
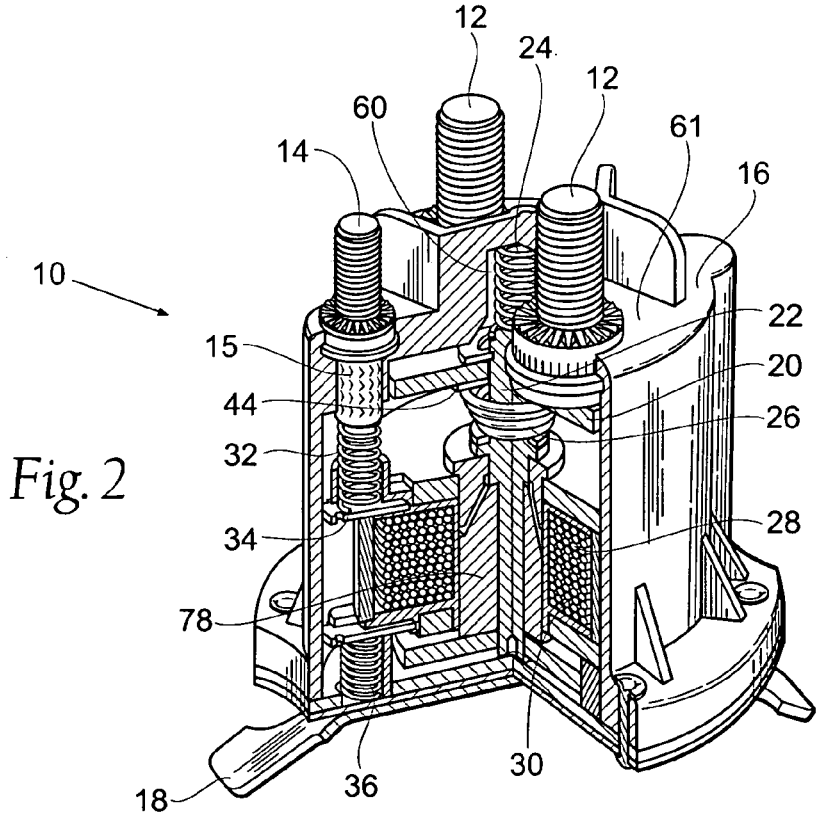
FIG. 2 is a cut-away view of the contactor shown along line 2—2 of FIG. 1.

FIG. 2 is a cross-sectional perspective view of the contactor 10. The studs 12 and 14 are nestled within the surface of the housing 16. A portion of the outer surface of the low current stud 14 has a knurled surface 15 located where the stud 14 sits within the housing 16, thereby restricting rotation of the stud 14 within the housing 16. A similar design located on the high current stud 12 will be discussed with respect to FIGS. 5 and 6. The high current studs 12 make contact with a contact disc 20, which is attached to an armature or plunger rod 22. The plunger rod 22 is biased against the housing 16 by way of a headspring 24. The headspring is nestled within a well 60 that holds the headspring 24 in proper alignment. A seal spring 26 maintains the static position of the contact disc 20 and allows the solenoid to over-travel to its internal stopping point thereby providing the contact disc 20 with a predefined load on the high current studs 12. The coil 30 allows a magnetic flux to pass to the plunger 78, which is forced upward and persuades the plunger rod 22 upward which in turn moves the contact disc 20 to make a connective bridge between the high current studs 12. The seal spring 26 preferably is of a high force design that provides for a low milivolt drop between the high current studs 12. The seal spring 26 is also preferably an inverted conical design to provide for a stable platform for the contact disc 20 to rest upon.

Still referring to FIG. 2, at least one low current terminal 14 is connected to a coil spring 32, which is in contact with a coupling means or terminal blade 34. The coil spring 32 is shown to be helical in shape, but any conductive connecting means that will transfer a current from the terminal 14 to the coil 30 via the terminal blade 34 will suffice. The terminal blade 34 is connected to the coil 30, thereby allowing an electrical connection for the low current coil terminal 14 through the spring 32 to the coil 30. As also shown in FIG. 2, in one contactor embodiment a similar lower spring 36 may be placed on the opposite side of the bobbin 28, thereby allowing the coil assembly to be grounded to a grounding means through its mounting cover 18.

Figure 3:
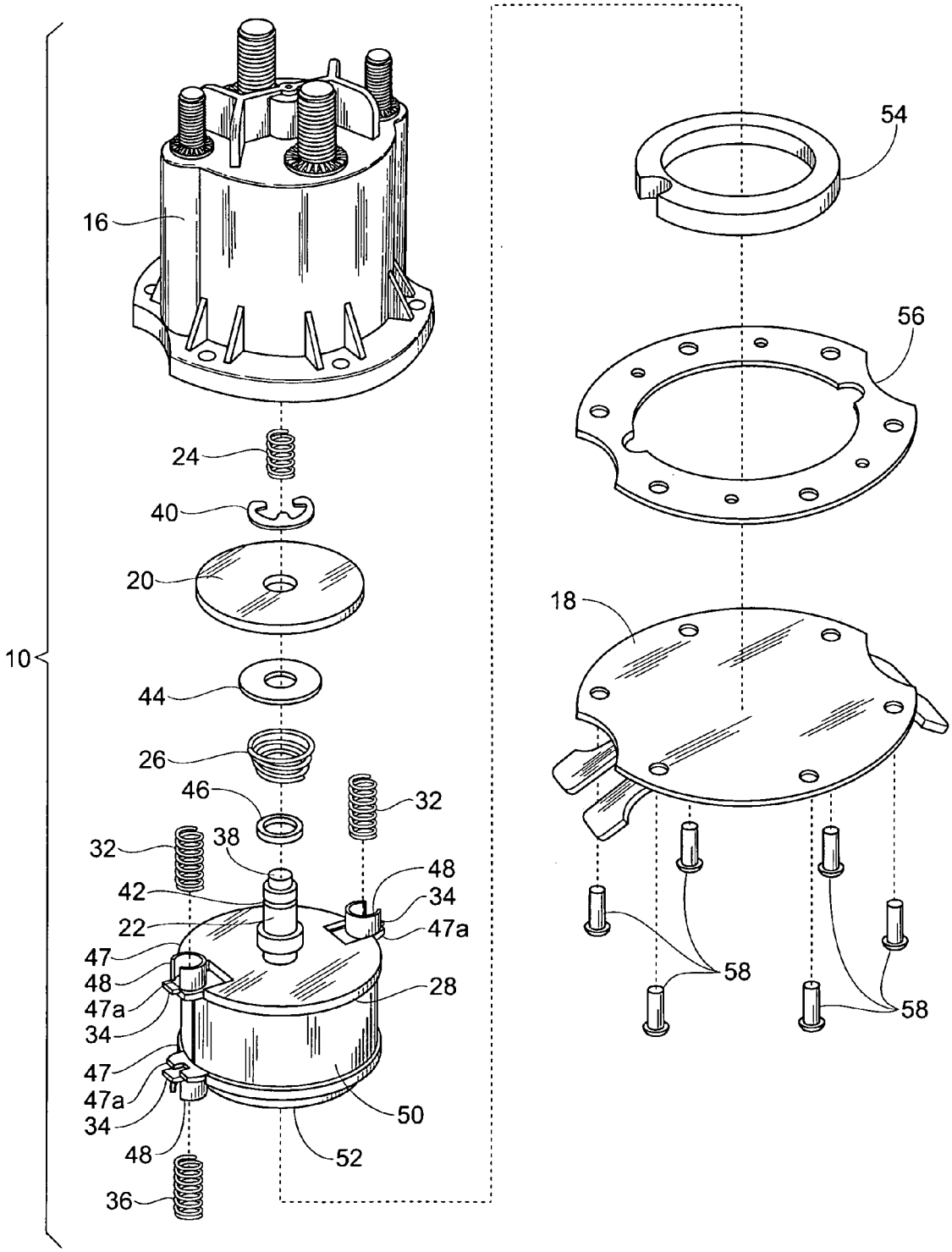
FIG. 3 is an exploded view of the contactor according to the present invention.

FIG. 3 is an exploded view of the contactor 10. The various elements of the contactor 10 are designed to easily fit within the housing 16. The headspring 24 and the contact disc 20, which is supported by the seal spring 26, sit on the plunger rod 22. The headspring 24 is fitted onto and mates with a ridged end 38 of the plunger rod 22, while a C-clip 40 that fits into a groove 42 holds the contact disc 20 in place. The mating of the headspring 24 and the ridged end 38 allows placement of the headspring 24 into the well 60 (see FIGS. 2 and 4) when the assembly is inverted, without needing to independently hold the headspring 24 in place. Such an arrangement eases manufacturing and allows for a less frustrating assembling process. The seal spring 26 slides over the plunger rod 22 and sits between a shoulder on the plunger rod 22 and the contact disc 20. Insulating washers 44 and 46 sandwich the seal spring 26.

Still referring to FIG. 3, the bobbin 28 has a pair of bobbin ends 47 with a plurality of projections 47*a* extending from the bobbin ends 47. In a preferred embodiment, the upper bobbin end 47 will have two projections 47*a* located on it, while the bottom bobbin end 47 will have one projection 47*a* located on it. The bobbin 28, bobbin ends 47, flanges 47*a*, and receptacles 48 may be molded as one piece or as individual pieces and secured together afterwards. The coil springs 32 are slid into respective chimneys or receptacles 48 that are attached to the projections 47*a*. The receptacles 48 hold the coil springs 32 in place, even if the bobbin 28 is inverted for insertion into the housing 16. The chimneys 48 also provide an efficient way for the coil springs 32 to contact the terminal blades 34. Similarly, and for the same purpose as the coil springs 32, the lower spring 36 sits within a chimney or receptacle 48. The lower spring 36 will also be held in place within the receptacle 48, without needing an exterior force when the lower spring 36 is pointing downwards in a normal position. While FIG. 3 shows the two coil springs 32 and also the lower spring 36 being present at the same time, this is only for illustration purposes. While such an arrangement is feasible, normally, there will only be two springs, either one coil spring 32 and the lower spring 36, or two coil springs 32, used in the contactor 10 at one time. Likewise, the terminal blades 34 will only be present when a corresponding spring is located within a corresponding chimney. While any springs or other similar devices may be used, the headspring 24, the coil springs 32, and the lower springs 36 are preferably of the same shape and design, thereby easing assembly and inventory.

Figure 7:
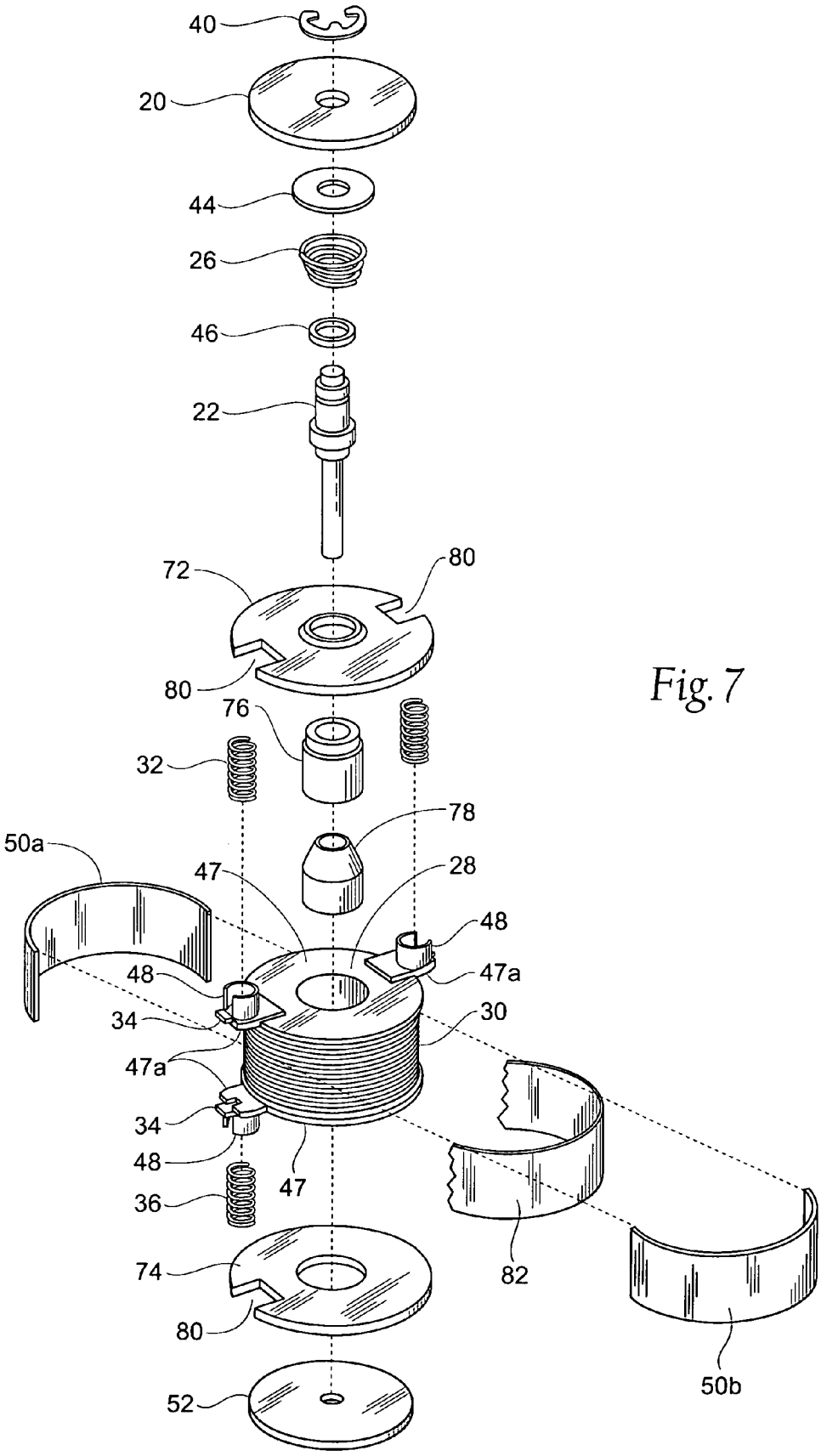
FIG. 7 is an exploded view of the solenoid used in the present invention.

FIG. 3 also shows a steel housing 50 sitting on the bobbin 28 around the coil 30 (see FIG. 7). The plunger rod 22 goes through the center of the plunger 78 (not shown), in turn the bobbin 28 and is held in place by a plunger washer 52. The bobbin 28 and the plunger rod 22 will be described in more detail with respect to FIG. 7. A compression washer 54 sits below the bobbin 28. The compression washer 54 is preferably a one-piece design that is either molded or cut from stock material. It preferably includes a recess so that it will not interfere with the chimney 48 located on the lower bobbin end 47. The compression washer 54 is preferably made from a resilient, flexible material such as neoprene. A gasket 56, preferably made of cork, rubber or a cork/rubber composite, sits between the housing 16 and the cover 18. The cover 18 is secured to the housing unit 16 by a plurality of rivets 58. While any fastening means may be used to secure the cover 18 to the housing unit 16, it is preferred that the rivets or fastening means 58 are arranged in an evenly spaced circular arrangement for equal loading of the gasket 56 for more efficient sealing purposes.

Figure 4:
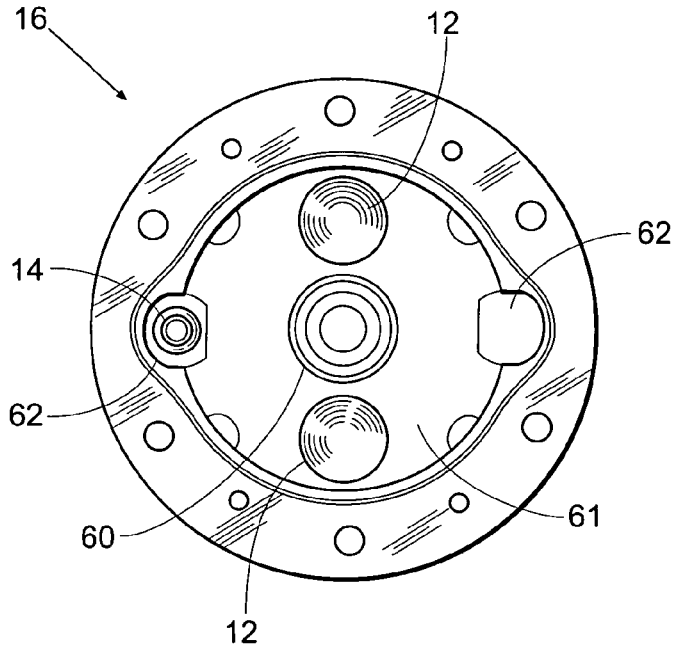
FIG. 4 is an interior bottom view of the solenoid housing.

FIG. 4 shows an interior bottom view of the housing unit 16. At the center of the housing sits the well 60 that allows the headspring 24 (not shown) to be situated within the housing 16. The well 60 provides a surrounding structure for the headspring 24 so that it will be properly biased against the plunger rod 22 (see FIG. 2) and will not slide around within the housing 16. The housing 16 has a pair of longitudinally extending channels 62, which correspond to the size and shape of the chimneys 48 (see FIGS. 2 and 3). The low current stud 14 is located in an end wall 61 of the housing 16 within the area defined by one of the longitudinally extending channels 62. The high current studs 12 can be seen situated in the end wall 61 on either side of the well 60. The mating effect of the chimneys 48 and the longitudinally extending channels 62 prevents the bobbin 28 (not shown) from rotating within the housing, which provides for an easier and more efficient assembly for locating the proper arrangement of the solenoid assembly and to further insure that the low current stud 14 will make contact with the coil spring 32.

Figure 5:
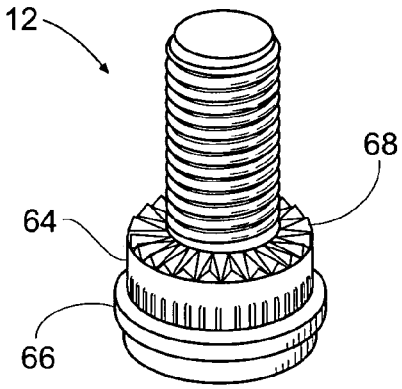
FIG. 5 is a close-up perspective view of a high current terminal or stud used in the present invention for current transfer showing the top of the stud.
Figure 6:
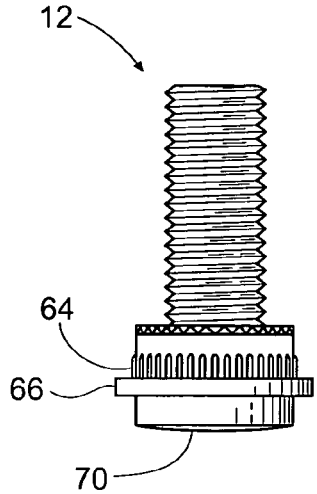
FIG. 6 is a close-up side view of a high current terminal or stud used in the present invention for current transfer showing the side of the stud.

FIGS. 5 and 6 show views of the high current terminal or stud 12. A ribbed area 64 and a lip 66 provide for a design that secures the stud 12 within the molded housing 16 (see FIG. 2). The ribbed area 64 restricts rotation of the stud when it is sealed within the end wall 61 of the housing 16. Above the ribbed area 64 is a knurl feature 68. When sealed within the end wall 61, the knurled area 68 will be located externally of the contactor housing 16. The knurl 68 assists in the mating of the stud 12 with an exterior wire or cable connector or other interconnecting hardware (not shown). A connected terminal wire or cable will be restrained from rotating by the knurl 68 during tightening of the nut (not shown). The stud 12 also has an end or contact pad 70 that is crowned. The crowned end 70 provides a more efficient mating surface for the contact disc 20, which results in a more consistent and reliable current passing through the stud 12.

An exploded view of the bobbin 28 and the plunger rod 22 is shown in FIG. 7. As previously stated, the C-clip 40 holds the contact disc 20 and the seal spring 26 on the plunger rod 22. The C-clip 40 allows the contact disc 20 and the plunger rod 22 to be mechanically connected to one another. It should be noted that any securing means, such as bolts, clasps, clips, pins, or other similar means, may be utilized in place of the C-clip 40, provided the means do not interfere with the assembly process. The plunger rod 22 will pass through the center of a top flux washer 72, the bobbin 28, and a bottom flux washer 74. The top flux washer 72 and the bottom flux washer 74 are separate structures from the bobbin flanges 47 of the bobbin 28. The plunger rod 22 also passes through a plunger casing 78 and a pole piece 76, both of which are situated within the center of the bobbin 28. The plunger rod 22 is connected to the plunger washer 52, which is located below the bottom flux washer 74. The plunger rod 22, the plunger casing 78 and the plunger washer 52 are designed as separate pieces and then staked or connected to one another. It should be noted that any securing means, such as threads, clasps, clips, pins, or other similar means, may be utilized in place of the staking process. While the pieces could be cut from raw material as a single piece, machining them as separate pieces is more cost effective, since there will be less scrap raw material. The plunger is also preferably of a geometry that is optimized for short stroke operating conditions, which will be used in shaping the solenoid force curve required for a predetermined level of performance. This is accomplished by allowing a larger diameter section of the plunger to operate outside the main coil assembly.

Still referring to FIG. 7, the top flux washer 72 and the bottom flux washer 74 are designed with notches 80 that fit around a corresponding projection 47*a* and chimney 48. The notches 80 loosely fit around the projections 47*a* and prevent the washers 72 and 74 from rotating separately of the bobbin 28 when assembled. The chimneys 48, projections 47*a*, bobbin flanges 47, and the bobbin 28 are preferably molded from a single piece of plastic, but could be designed as separate pieces and fastened together. The wound coil 30 sits on the bobbin 28 and is connected at its respective ends to the respective terminal blades 34. The coil 30 is wrapped with a protective insulating layer 82, which sits between the coil 30 and the steel housing 50. The elements shown in FIG. 7 are assembled as an independent subassembly, which allows the elements to be assembled and visually verified for accuracy prior to being placed within the housing 16 (not shown). Such an arrangement also allows for the critical components to be assembled outside of the housing unit 16.

As shown in FIG. 7, the steel housing 50 is designed of two halves, 50*a* and 50*b*. The halves 50*a* and 50*b* are preferably substantially identical sections assembled symmetrically around the bobbin 28. Such an arrangement provides for an efficient flux path for the coil 30, since no gap is needed in the housing 50 to clear the bobbin 28 during assembly. Furthermore, the housing 50 has an advantage over a rolled, single section housing in that the housing 50 does not have to be compressed to be fit properly around the bobbin 28 and to also fit within the housing unit 16. The halves 50*a* and 50*b*, along with the bobbin 28, may be easily slipped into the housing unit 16 without any additional reshaping or reforming of the steel housing 50, which is normally necessary with single piece designs. While the invention would work with a single section housing unit, it is advantageous to have the arrangement described above.

Figure 8:
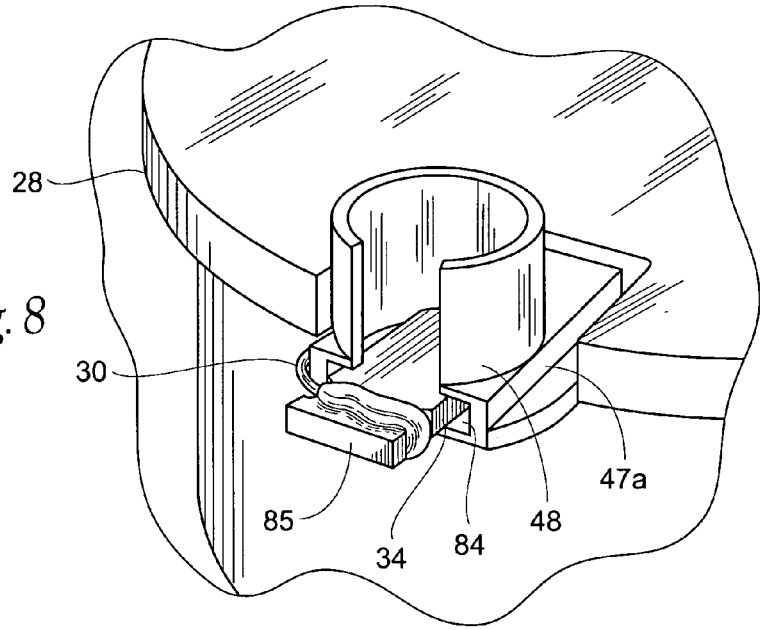
FIG. 8 is close-up sectional view of the projection area of the bobbin.

FIG. 8 is a close-up exploded view of the projection 47*a*, the chimney 48 and the terminal blade or coupling means 34. A slot 84, which is located within the projection 47*a*, receives the terminal blade 34. The slot 84 extends inwardly past the area of the projection where the chimney 48 is located, allowing the terminal blade 34 to be in solid contact with one of coil springs 32/36 (not shown). Preferably, the end of the coil 30 is attached to the terminal blade 34 by welding, soldering or other attachment means that will allow a current to pass from the coil 30 to the terminal blade 34. The arrangement of the projection 47*a*, the chimney 48, and the blade 34 allows for easy assembly and connection of the coil 30 to the blade 34. As previously stated, the projections 47*a* and the chimneys 48 are preferably molded as one piece, but it is possible that they could be molded individually and then later joined together. Likewise, the chimneys 48 are shown to be cylindrical so that they are in mating relationship with the coil springs 32/36. However, it is within the realm of this invention for the chimneys 48 to be of any shape that will provide a mating relationship with the springs 32 and 36, which may also be of other shapes and designs than the currently shown springs.

After the bobbin 28, the projection 47*a*, and the chimney 48 are assembled or formed, the blade 34 may then be slid into the slot 84, preferably extending the entire length of the slot with a small lip 85 located outside of the slot 84. The lip 85 will provide an area for the end of the coil 30 to be secured to the blade 34. Because the lip 85 is located outside of the bobbin 28, less manipulation is required in securing the separate parts, which results in an easier and more efficient assembly process.

Figure 9:
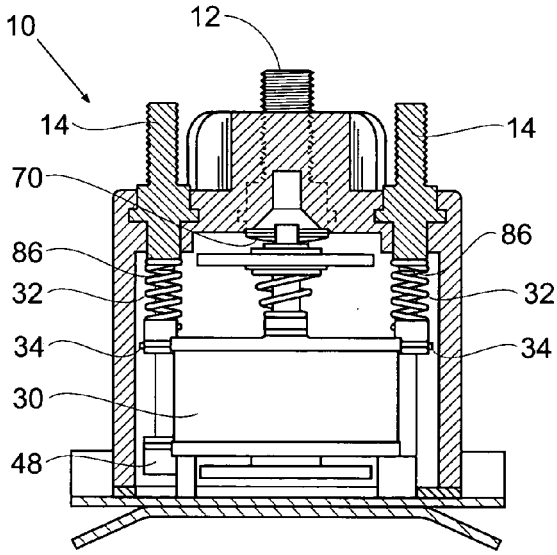
FIG. 9 is a cross-sectional view of a first embodiment of the contactor according to the present invention taken along the line 9—9 of FIG. 1.

FIG. 9 is a side view of a contactor 10 showing the solenoid being connected to two low current studs 14. In this arrangement, two coil springs 32 are present. Each spring 32 is connected to one of the low current studs 14, with one stud 14 connected to the positive polarity of a voltage source and the other stud 14 connected to the negative polarity of a voltage source or chassis ground. The low current studs 14 include a post 86, which the coil spring 32 will mate around to further insure a secure contact between the spring 32 and the stud 14. As current enters the solenoid through the low current stud 14, it flows through the coil springs 32, the terminal blade 34, and into the coil 30. The result is the contact disc 20 is forced upward from the magnetic flux produced from the coil 30, and the disc 20 makes contact with each contact pad 70, thereby providing a bridge for the high current terminals 12. The lower spring 36 is not present in this arrangement. Also, there is no terminal blade 34 located in the chimney 48 that would normally house the lower spring 36.

Figure 10:
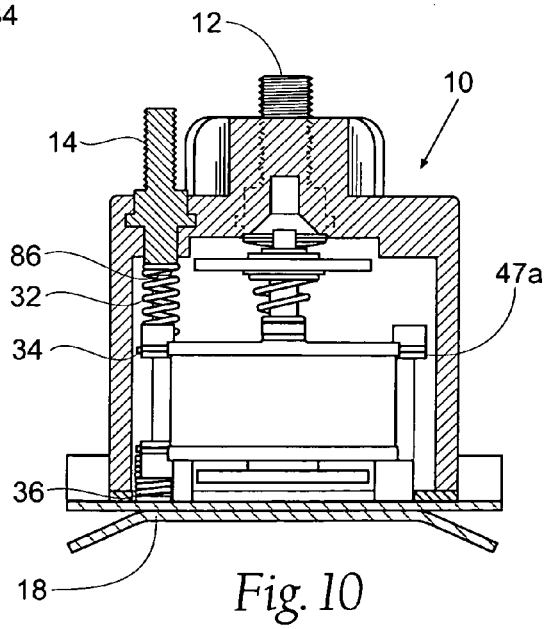
FIG. 10 is a cross-sectional view of a second embodiment of the contactor according to the present invention taken along line 10—10 of FIG. 1.

FIG. 10 is a side view of a contactor 10 having a single low current stud 14 mounted in the housing 16. This single stud 14 receives the input current. The coil spring 32 is connected to the stud 14 and the post 86 and makes a connection to the upper terminal blade 34. Power is transferred across the high current terminals 12 in the same fashion as in FIG. 9. However, in this arrangement, the lower spring 36 is present and connected to the lower terminal blade 34. The lower spring 36 is in contact with the cover 18, which provides one of the coil connection paths, usually via chassis ground. The second coil spring 32 that was present in FIG. 9 is not present, and the respective projection 47*a* for the second coil spring 32 does not have the terminal blade 34 connected to it, either.

The design of the housing unit 16 is such that the end wall 61 (see FIGS. 1 and 2) is portrayed as being opposite of where the cover 18 is located. However, the end wall 61 should be construed broadly as an area of the housing unit 16 where the terminals 12 and 14 are located. For instance, if the terminals were located in the cylindrical portion of the housing 16, that should also be considered as the end wall 61. Likewise, the longitudinally extending channels 62, terminals 12, and terminals 14, are shown to be diametrically opposed. While such a design may be advantageous for manufacturing and design purposes, it is not critical for the present invention. Provided there is sufficient insulation between the different electrical contacts, any arrangement will be within the scope of the present invention.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A contactor comprising:

an insulating housing having an open end and an enclosed end wall spaced apart from said open end, said housing unit defining a cavity, said cavity including longitudinally disposed channels;

said end wall including a plurality of high current terminals protruding through said end wall, each said high current terminal defining an internally located contact pad within said cavity;

said end wall including at least one low current terminal protruding through said end wall and defining coil contact means within said cavity;

a solenoid assembly proximate to said open end of said housing unit, said solenoid assembly comprising:

a bobbin;

a coil wound on said bobbin, said bobbin comprising a pair of bobbin ends with at least one radially extending projection from at least one of said bobbin ends, each projection including a receptacle for receiving a connection means, said connection means connected to said coil contact means;

coupling means to connect said coil to said connection means, said projection receiving said coupling means;

said receptacle nested in one of said longitudinal channels;

an axially movable armature projecting from said bobbin terminating in a contact disc, said contact disc being in a bridgeable relationship with said contact pads; and a cover fastened to said open end of said housing, said cover securing said coil assembly within said housing unit.

2. The contactor according to claim 1 wherein said internal contact pad of each said high current terminal comprises a crowned surface.

3. The contactor according to claim 1 wherein each said high current terminal further comprises an external knurled surface.

4. The contactor according to claim 1 wherein said low current terminal further comprises an external knurled surface.

5. The contactor according to claim 1 wherein said connecting means comprises a spring.

6. The contactor according to claim 5 wherein said contact means comprises a post, said spring mating with said post.

7. The contactor according to claim 1, wherein said cover further comprises a mounting bracket.

8. A contactor comprising:

an insulating housing having an open end and an enclosed end wall;

said end wall including at least two high current terminals protruding through said end wall, each said high current terminal defining a crowned internal contact pad, said end wall including at least one low current terminal protruding through said end wall and forming a post within said cavity;

a coil assembly proximate to said open end of housing, said coil assembly comprising:

a bobbin;

a coil wound on said bobbin;

means for connecting said post to said coil, an axially movable armature projecting from said bobbin terminating in a contact disc, said contact disc being in a bridgeable relationship with said contact pads; and a cover fastened to said open end of said housing, said cover securing said coil assembly within said housing.

9. The contactor according to claim 8 wherein said high current terminal comprises an external knurled surface.

10. The contactor according to claim 8 further comprising a coil housing surrounding said coil, said coil housing formed of two separate identical sections arranged symmetrically.

11. The contactor according to claim 8 wherein said armature further comprises a plunger, a plunger rod, and a plunger washer, said plunger, plunger rod and plunger washer formed as individual components.

12. The contactor according to claim 8 further comprising a headspring, said headspring mated onto an end of said coil assembly and biased against said housing unit end wall.

13. The contactor according to claim 12 further comprising a well located in said end wall, said well receiving said headspring.

14. The contactor according to claim 8, wherein said cover further comprises a mounting bracket.

15. A contactor comprising:

an insulating housing having an open end and an enclosed end wall spaced apart from said open end, said housing unit defining a cavity, said cavity including longitudinally disposed channels;

said end wall including a pair of high current terminals protruding through said end wall, each of said high current terminals defining an internally located contact pad within said cavity, said end wall including at least one low current terminal protruding through said end wall and forming contact means within said cavity;

a coil assembly proximate to said open end of said housing unit, said coil assembly comprising:

a bobbin;

a coil wound on said bobbin, said bobbin comprising a pair of bobbin ends with at least one radially extending projection from at least one of said bobbin ends, each projection including a receptacle for receiving connection means, said connection means connected to said contact means;

coupling means to connect said coil to said connection means, said projection receiving said coupling means;

said receptacle nested in one of said longitudinal channels;

an axially movable armature projecting from said bobbin terminating in a contact disc, said contact disc being in a bridgeable relationship with said contact pads; and a cover fastened to said open end of said housing, said cover securing said coil assembly within said housing.

16. The contactor of claim 15 comprising a plurality of projections and wherein one of said projections is connected to said connection means and another of said projections is connected to a second connection means, said second connection means connected to said cover.

17. The contactor according to claim 16 wherein each of said projections is nested in one of said longitudinal channels.

18. The contactor according to claim 17 wherein said first connection means and said second connection means comprise springs.

19. The contactor of claim 18 wherein said coupling means further comprises a conductive blade, said conductive blade mounted on said projection.

20. The contactor of claim 15 comprising a plurality of projections and wherein one of said projections is connected to said connection means and another of said projections is connected to a second connection means, said second connection means connected to a second low current terminal.

21. The contactor of claim 20 wherein one of said projections is nested in one of said longitudinal channels, and the other of said projections is nested in an oppositely disposed longitudinal groove.

22. The contactor of claim 15 wherein said coupling means further comprises a conductive blade, said conductive blade mounted on said projection.

23. The contactor according to claim 15 further comprising a coil housing surrounding said coil, said coil housing formed of two separate substantially identical sections arranged symmetrically.

24. The contactor according to claim 15, wherein said cover further comprises a mounting bracket.

* * * * *